US006578217B1

(12) United States Patent
Roberson

(10) Patent No.: US 6,578,217 B1
(45) Date of Patent: Jun. 17, 2003

(54) CUSHION AND METHOD FOR ACCOMMODATING MULTIPLE BODY POSITIONS

(76) Inventor: Orin A. Roberson, 8701 Town Park #3102, Houston, TX (US) 77036

( * ) Notice: Subject to any disclaimer, the term of this patent is extended or adjusted under 35 U.S.C. 154(b) by 0 days.

(21) Appl. No.: 10/020,841

(22) Filed: Nov. 30, 2001

(51) Int. Cl.[7] ..... A47G 9/00; A47C 27/00

(52) U.S. Cl. ..... 5/632; 5/648; 5/653; 5/703; 224/155; 224/257; 297/423.12

(58) Field of Search ..... 5/630, 632, 648, 5/653, 654, 703, 652, 657; 297/423.12; 224/155, 257

(56) References Cited

U.S. PATENT DOCUMENTS 1,140,043 A * 5/1915 Knickmeyer ..... 5/703
3,333,286 A * 8/1967 Biolik ..... 5/648
4,377,309 A * 3/1983 Mengshoel ..... 297/423.12
4,772,071 A * 9/1988 Richards ..... 297/423.12
5,073,986 A * 12/1991 Farrago
6,298,508 B1 * 10/2001 McCloskey ..... 5/632

* cited by examiner

*Primary Examiner*—Alexander Grosz
(74) *Attorney, Agent, or Firm*—Darcell Walker

(57) ABSTRACT

This invention is an adjustable, ergonomically sound apparatus for the human body to assume many positions such as kneeling, sitting or lying. The main components of the invention are comprised adjustable cushions with adjustable supports for the knees, ankles, feet, toes, buttocks, back legs and head. This invention is portable and allows the user to assume the positions of kneeling, sitting and laying for long periods of time on a mobile basis with out the pain, discomfort and lasting damage associated with going long periods of time in these positions without proper supports.

3 Claims, 3 Drawing Sheets

CUSHION AND METHOD FOR ACCOMMODATING MULTIPLE BODY POSITIONS

CROSS REFERENCE TO RELATED APPLICATION

This application is related to patent application Ser. No. 09/575,391, filed on May 22, 2000, now abandonded the contents of which are incorporated by reference.

FIELD OF THE INVENTION

This invention relates to a device and method for supporting various parts of a person's body and more particularly to a multi-component cushion kit on which a person can rest in a variety of positions and during various activities.

BACKGROUND OF THE INVENTION

People spend a considerable amount of time in sitting, kneeling and laying positions, when participating in numerous activities. In order to meet the body support requirements of these positions, it has been customary to utilize a plurality of pillows and cushions, which, however, are cumbersome, unwieldy and of limited functional effectiveness. In the case of prone lying, persons also frequently resort to leaning on their forearms while raising and straightening their upper bodies to permit the pursuit of activities requiring frontal vision. This forearm-support method, however, requires considerable muscular effort, as it requires continuous isometric contraction of the triceps muscles and also places prolonged hyperlordosic strain on the lower back, as well as concentrated and painful pressure on the elbows.

Prior solutions to this problem have consisted of using multiple cushion mat combinations. While various multiple-cushion foldable mats, mat-headrest combinations and other mattress and lounging devices have been taught in prior art to effect multi-positional body support, none of these combinations provide adequate comfort for prone and supine lying positions, and various other static and dynamic positioning requirements, particularly with respect to support of a person's head. U.S. Pat. No. 4,987,625 to Edelson discloses a personal support apparatus that a person can use when in a laying or prone position. This apparatus attempts to supply upper body support when a person is in a laying position. However, this invention does not address the discomfort that a person can feel in sitting or kneeling positions. Another U.S. Pat. No. 5,029,350 to Edelson describes a cross-legged seating device. Two cushions of particular shape and relation are flexibly joined in such manner as to provide optimum support for cross-legged sitting, and may also be folded upon each other for ease of storage and convenient carrying by means of an integral semi-concealed handle. One of these two cushions has the cross-section of a trapezoid with a horizontal base, two vertical sides of unequal lengths, and a top surface, which slants downwards from the longer to the shorter vertical side. This cushion supports the buttocks of the user. The other cushion has the cross-section of a rectangle whose longer parallel sides are the same length as the cross-sectional base of the trapezoidal cushion, and whose shorter parallel sides are less than the length of the shorter vertical cross-sectional side of the trapezoidal cushion. This cushion supports the shins, ankles and feet of the user. The cushions are joined by a flexible hinge along a bottom edge of the rectangular cross-sectional cushion, and the bottom edge of the shortest side of the trapezoidal cross-sectional cushion. A handle is attached to the shorter vertical side of the trapezoidal cushion such that it is partially concealed in the slot formed by the flexible hinge between the two cushions when both cushions are extended for sitting. The flexible hinge also permits the rectangular cross-sectional cushion to be folded neatly under the trapezoidal cross-sectional cushion for easy transport and storage of the device.

These products are all high quality, however, they are intended for specialized medical use. As a result these products suffer from a number of deficiencies when considered against the objects of the present invention. For example, they lack adequate head support, are of oppressively firm density for extended use, are coated with a tactually unappealing material, exude an unpleasant odor, and are heavy, bulky and relatively expensive.

Kneeling can be one of the most uncomfortable positions for the human body. The position of the person's toes, legs and knees while kneeling often cause the person to be uncomfortable and in pain. In a kneeling position the toes, legs and knees support the person's body weight. Maintaining a kneeling position for extended periods of time can lead to body strain, discomfort and damage to a person's feet, ankles, knees and legs.

One particular activity that can require extended periods of kneeling is when a person is praying. During a prayer session, a person can spend more than an hour on his or her knees in a praying position. In addition, during this activity the person is in a stationary position on their knees usually for the entire time. The lack of movement causes all of the force of the person's weight to focus in one area and can lead to damage in that area.

Some of the current kneeling products offer cushions for the knees when the user is kneeling on a hard surface but these cushions offer no support for the feet and ankles to reduce the pressure and subsequent pain being placed on the person's toes, feet and ankles. Other kneelers do not address the over extension of the knee joints when in the kneeling position. In addition, many kneeling products are not portable and others lack practicality in being considered appropriate to carry to various events, meetings and other gatherings. Current kneeling products do not address the painfully uncomfortable feeling of resting the user's buttocks on the often-uneven surfaces of the user's heels or shoes. Furthermore, kneeling products do not accommodate the user's need or desire to change their physical position for the other functions or activities.

SUMMARY OF THE INVENTION

This invention is an adjustable, ergonomically sound apparatus for the human body to assume many positions such as kneeling, sitting or lying. The main components of the invention comprise well-placed adjustable cushions with adjustable supports for the knees, ankles, feet, toes, buttocks, back legs and head. This invention is portable and allows the user to assume the positions of kneeling, sitting and laying for long periods of time with out the pain, discomfort and lasting damage associated with going long periods of time in these positions without proper supports.

This invention also incorporates a method to position the cushion members of this apparatus such that they support a person's knees, legs and ankles and feet when the person is in various kneeling, sitting and laying positions.

DESCRIPTION OF THE INVENTION

The present invention comprises interlocking cushions that are capable of being arranged in several configurations to ergonomically support a person in various body positions such as kneeling, sitting and laying positions, in order to reduce and prevent pain, discomfort and damage to the body over any period of time. Dimensions of this invention shown in FIG. 1 will vary according to the Anthropometrics of the user's age, sex, and body shape. Alternate embodiments will include different material coverings, internal and/or external mechanical devices to affect width, height, and length and the mechanisms for portability such as sliders or wheels. The cushions are moldable to the contours of the person's body and the ankle support/head rest/back or knee support can be removed, lowered, or rotated out of the way to make the unit thinner and easier to carry.

Figure 1:
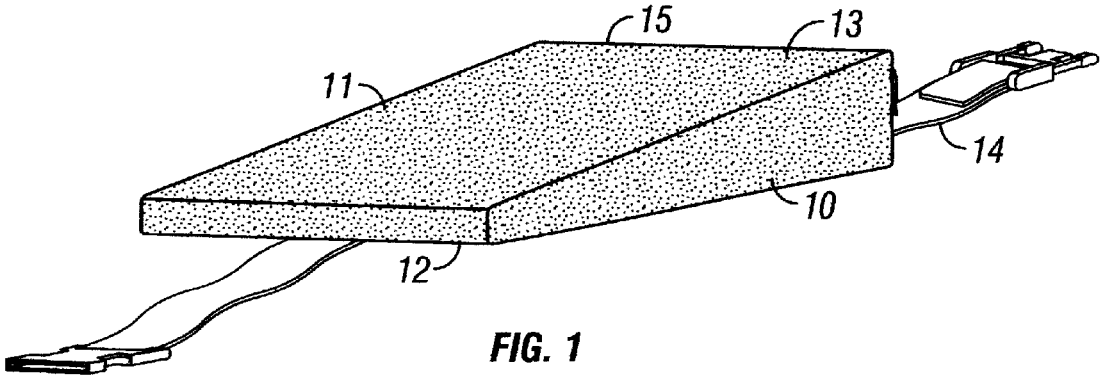
FIG. 1 is an isometric view of the knee, leg, ankle and foot cushion of the present invention.

The present invention combines the use of a series of well-placed therapeutic cushions to support the user in several ways during several different positions. Each of the cushions can be made with an inflatable and/or mechanical device inside for adjustment for different sized people. The present invention differs from the conventional pillow and chair, in that it allows therapeutic support that gives a portable, comfortable and therapeutic means to the user when they are in the kneeling, sitting and laying positions. Referring to FIG. 1, the invention is a cushion on which a person can kneel. The device has a substantially flat bottom surface 10. This surface will be in contact with a floor, the ground or other structural means, which supports the person. The top surface 11 has a slope or taper that is low on one end 12 of the device and higher at the top end 13. The device also has a strap 14 for use in transporting the device. As a person kneels onto the cushion, the person's knees are positioned towards the lower end 12 of the cushion. The person's shins rest on the tapered top surface of the cushion. The front portion of a person's leg/ankle joint fits and rests against the top edge 15 of the cushion. The tapered shape and high side 13 also elevates and supports the person's feet. This elevation and support reduces the amount of strain typically placed on the ankles and feet during kneeling.

Figure 2:
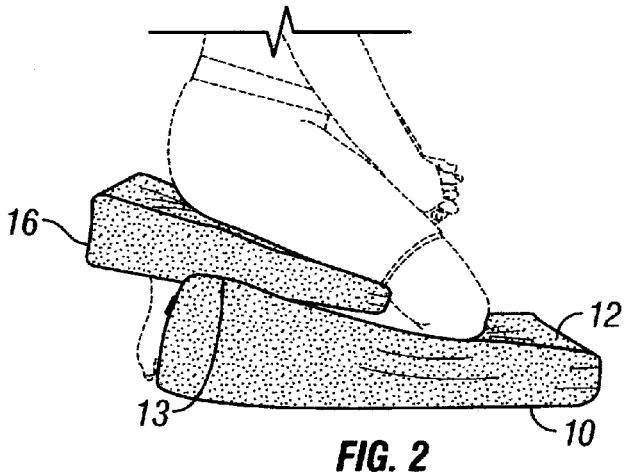
FIG. 2 is an illustration of the placement of the cushions being implemented during the kneeling position of a person.

FIG. 2 illustrates the implementation of this device when a person, kneels on it. As shown, the knees rest on the lower end of the device. The ankles rest on the top edge with the feet elevated and supported by the top end of the cushion. A second cushion 16 works in conjunction with the first cushion to further support the person's weight when in the kneeling position. This cushion 16 is positioned between the person's thighs and buttocks and above the shins as shown in FIG. 2. This cushion supports the weight from the thighs and buttocks. In addition, depending on the placement of the cushion, the angle of the knees will alter and thereby, increase or decrease the stress on the knees resulting from bending the knees. This cushion provides a comfortable therapeutic means of-kneeling for long periods of time.

Figure 3:
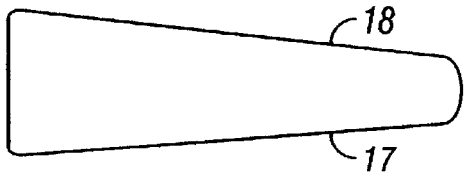
FIG. 3 is a side view of the support cushion for the buttocks area during a kneeling position.
Figure 4:
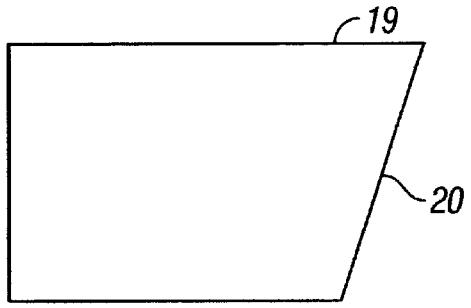
FIG. 4 is an alternate embodiment of the support cushion for the buttocks area.

This second cushion can have a variety of designs. FIG. 3 shows a design of a second cushion having both surfaces 17 and 18 tapered. FIG. 4 has a substantially straight side 19 and a partially tapered side 20.

Figure 5:
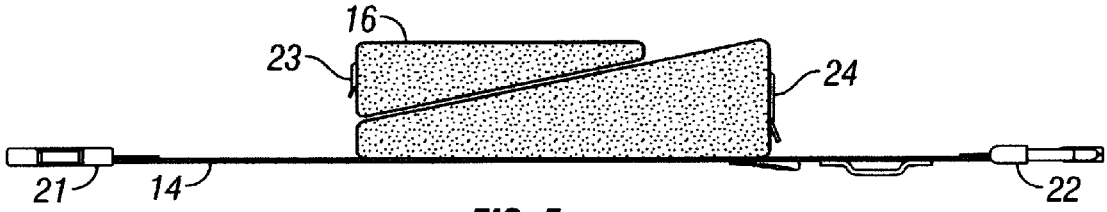
FIG. 5 is a side view of the present invention with a carrying strap attached to the cushions.
Figure 6:
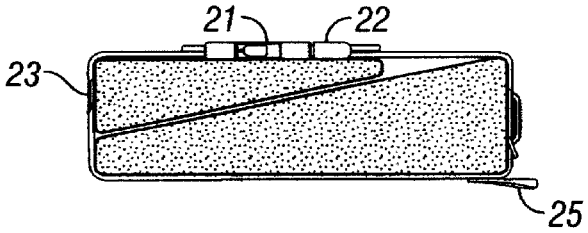
FIG. 6 is a side view of the cushion components of the present invention folded for transport.

FIG. 5 shows the two-cushion device with a carrying strap. The carrying strap 14 has ends 21 and 22. Each cushion also has an attaching means 23 and 24 that engage the strap when the device is packaged for transport. As shown in FIG. 6, the strap 14 feeds through attaching means 23 and 24. The ends 21 and 22 of the strap also have attaching means, such as a buckle that engage each other to tighten and secure the strap around the cushions. The device can also have a handle 25 or shoulder strap for carrying the device.

Figure 7A:
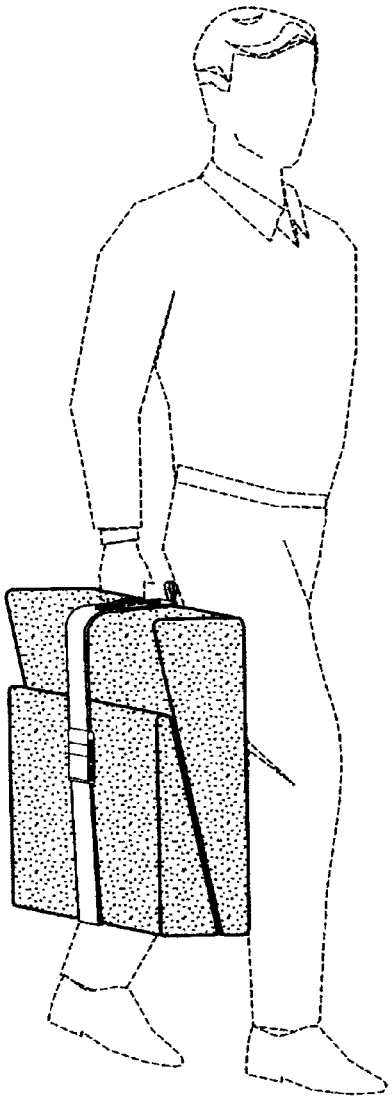
FIGS. 7*a* and 7*b* shows two methods of carrying and transporting the cushions.
Figure 7B:
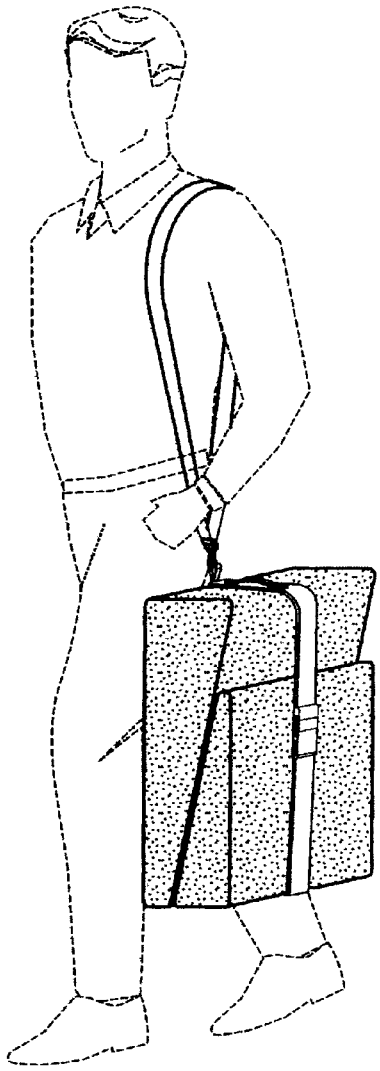

FIGS. 7*a* and 7*b* show two ways of transporting the device of the present invention. As shown in FIG. 7*a*, a person can carry the device with a handle. FIG. 7*b* shows the device being carried on the person's shoulder.

The material of construction can be any material or combination of materials that provide support for the areas of concern. The invention will be able to support various sizes of people by having different sizes for different size and/or adjustable cushions. Straps can be added to create a design as a backpack. An accessory pouch for carry other items like straps, Bible, etc. The cushions have an inflatable or mechanically adjustable lumbar support for use during sitting and laying configurations.

The present invention has other features that include the following:

1. The invention can be used on a portable and non-portable basis.
2. The invention can be made with more than one occupant versions or made to be able to be linked together to obtain the same effect.
3. The invention can be made with the optional hand rail to aid in ascending off and descending onto the unit.
4. The invention could be used in its basic form as a seat cushion on top of another chair, bench, etc.

The present invention provides many advantages and benefits over other pillow cushions. Some of these benefits are that this invention: Relieves the strain placed on the toes when a person is in the kneeling position by preventing the user's full weight from being placed on the user's toes ankle and foot; Relieves the strain placed in the ankle when a person is in the kneeling position by preventing the person's full weight from being placed on the ankle from an awkward angle; Relieves the strain placed on the knees when a person is in the kneeling position by providing a cushion between the user's knees and a hard surface; Relieves the strain that is normally placed on the knee joints through over extension by limiting the degree of bending that takes place when in the kneeling position; Provides for more adequate distribution of the user's body weight while in the kneeling position via adjustable cushions for the elimination of discomfort at the pressure points; Provides relief from the pain and discomfort of the buttocks and heels when in the kneeling position by providing a cushion between the two. The cushion provides a flat comfortable surface for the buttocks to rest on and a comfortable barrier to pain for the heels; Promotes proper posture of the body when in the kneeling position, while promoting circulation; Strap back feature allows portability of the invention; Relieves the pressure strain exerted on the buttocks when sitting on a hard surface by providing a cushion that rests between the user's buttocks and the hard surface; Relieves the discomfort of sitting on a flat surface with the legs fully extended by providing an adjustable knee joint support which allows the user's legs to bend relaxing the user's leg muscles and relieving back strain and promoting circulation; Relieves the discomfort of the user resting his/her back against a hard surface by providing a cushion that rests between the user's back and the hard surface; Unit's cushions are fitted with adjustable lumbar supports in the back cushion that is either mechanical or inflatable; Ability to adjust the incline of the back pillow based on the incline of the surface being rested on or the optional back pillow stands/braces; and Flexibility for anyone needing to assume the kneeling, sitting or lying positions for any period of time for instance but not limited to prayer, meditation, yoga, workshops, crafts, seminars and will accommodate adult and children orthopedic deformities, playing games, gardening, carpentry, plumbing, electrical work, mechanics and other trade vocations requiring kneeling or laying.

The present invention provides additional benefits over other pillow cushions. Some of these benefits are that this invention:

- The user can adjust the level of support by moving the cushion back and forth and positioning themselves at various points on the lower cushion;
- The cushions can accommodate various body styles and shapes via the moveable cushions;
- The configurations for the cushions can be implemented with a shoulder strap, a backpack configuration or and handle; and
- The device of the present invention prevents over extension of leg and foot muscles, quadriceps and leg and thigh muscles such as hamstrings.

The device of the present invention prevents over extension of leg and foot muscles, quadriceps and leg and thigh muscles such as hamstrings. The apparatus of this invention provide significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. A method for supporting a person's lower body when that person is in a kneeling position, with the aid of a first and second cushion member that are tightly securable to each other, for ease of transport, with the aid of a strap means, insertable and removable through attaching means attached to said first and second cushion members, comprising the steps of:

separating said first and second cushion members, attached to each other with a strap means adapted to surround said cushion members and having ends attachable to each other;

positioning said first cushion member such that a person's knees and shins rest on this first cushion member which has a front end and a rear end and a tapered upper planner supporting surface such that the rear end of the upper supporting surface has a higher elevation than the front end of the supporting surface, said positioning of the person's knees and shins being such that the first cushion member provides a cushioned barrier between the person and the primary supporting surface and such that the person's feet are elevated by the rear elevated end of the first cushion member;

elevating the person's feet and ankles on said first cushion member such that the person's feet, ankles and toes rest off of the primary supporting surface; and position said second cushion member between the back of the person's thighs and the person's legs, said second cushion member supporting the weight of a person's buttocks and the thighs.

2. The method as described in claim 1 further comprising the step of reducing the strain of a person's knees by supporting the weight of a person's buttocks and thighs with the second cushion member positioned between the back of the person's thighs and the person's legs.

3. The method as described in claim 2 wherein said reduction of strain comprises restricting the ability of the knee to bend during the kneeling position and thereby reduce the strain that results from bending the knees.

* * * * *